US005119593A

United States Patent [19]

Bae

[11] Patent Number: 5,119,593

[45] Date of Patent: Jun. 9, 1992

[54] DOOR MADE OF LAMINATED LUMBER AND HAVING VENTILATING HOLES

[76] Inventor: Sung-Tae Bae, 105-801 Green Mansion, 50 Songhyun-dong, Nam-ku, Daegu, Rep. of Korea

[21] Appl. No.: 667,133

[22] Filed: Mar. 11, 1991

[30] Foreign Application Priority Data

Mar. 30, 1990 [KR] Rep. of Korea ..... 90-3779
Dec. 27, 1990 [KR] Rep. of Korea ..... 90-21157

[51] Int. Cl.[5] ..... E06B 3/00

[52] U.S. Cl. ..... 49/501; 49/506; 52/457; 52/630; 52/782

[58] Field of Search ..... 49/501, 506; 52/821, 52/782, 630, 457, 458

[56] References Cited

U.S. PATENT DOCUMENTS 3,172,170 3/1965 Webster ..... 52/782 X
3,512,304 5/1970 Meuret ..... 49/501
4,034,512 7/1977 Lindal ..... 49/501
4,908,990 3/1990 Yoon et al. ..... 49/501

FOREIGN PATENT DOCUMENTS 1298980 6/1962 France ..... 49/501
2421265 11/1979 France ..... 49/501
2444150 8/1980 France ..... 49/501
2590331 5/1987 France ..... 59/501
96432 10/1922 Switzerland ..... 49/501

*Primary Examiner*—Philip C. Kannan
*Attorney, Agent, or Firm*—Lowe, Price, LeBlanc & Becker

[57] ABSTRACT

A door made by assembling a plurality of laminas and having ventilating holes is disclosed. The door is provided with longitudinal and lateral ventilating holes, so that twisting and other deformation of the door is prevented.

7 Claims, 8 Drawing Sheets

DOOR MADE OF LAMINATED LUMBER AND HAVING VENTILATING HOLES

FIELD OF THE INVENTION

The present invention relates to a door made of a plurality of laminas and having ventilating holes, as well as having the same strength as a door made of solid woods.

BACKGROUND OF THE INVENTION

There are many kinds of doors such as gates installed outdoors, and living room doors and furniture doors installed indoors.

Generally, the conventional doors are constituted such that: the solid peripheral frame members are joined together in the form of " , " and a plywood is fitted to the frame of the door. However, this conventional door has disadvantages such that: the joined portions of the frame are easily damaged, and it is impossible to inscribe exquisite patterns.

However, recently, in an attempt to overcome the above described disadvantages, there has appeared a door made of a plurality of laminas and having the same structure as the solid wood doors, and this door has been put to the practical use.

The manufacturing process for this door will be briefly described. That is, a sufficiently dried wood is cut into laminas of a cetain thickness, and a strong adhesive is spread on the surfaces of the laminas. The laminas are then assembled and pressed by a high power press before finishing. Thus, doors of various kinds can be manufactured.

Disadvantages occur when rectangular laminas are simply put together to form a door as described above for example, twisting and other deformations can occur during use; the weight of the door is also increased.

As shown in FIG. 11, pipes 10 can be buried into the upper and lower portions of the door to prevent twisting and other deformation. However, in such a case, not only the manufacturing process becomes complicated, but also the door can produce cracks upon receipt of impacts.

SUMMARY OF THE INVENTION

The present invention is intended to overcome the above described disadvantages of the conventional doors.

Therefore it is an object of the present invention to provide a laminated lumber door having ventilating holes, in which, when assembling the laminas, ventilating holes are formed in the longitudinal and lateral directions, thereby preventing twisting and other deformation of the door, realizing the light weight of the door, making the door spread the pleasant natural odor all the time, and obtaining a sound shielding effect.

BRIEF DESCRIPTION OF THE DRAWINGS

The above objects and other advantages of the present invention will become more apparent by describing in detail the preferred embodment of the present invention with reference to the attached drawings in which.

DESCRIPTION OF THE PREFERRED EMBODIMENT

In forming the laminated lumber door according to the present invention, a plurality of molded inner laminas 1 having the cross sectional shape of " " are assembled together in a planar form, and a pair of molded outer laminas 2,2' having the cross sectional shape of " " are put to the opposite sides of the assembly of the inner laminas 1. The inner laminas 1 are assembled in such a manner that longitudinal ventilating holes 3 are formed between the adjacent laminas 1 in the longitudinal direction. In addition, lateral ventilating holes 4 are provided such that they intersect the longitudinal ventilating holes 3, these lateral ventilating holes 4 being provided at certain uniform intervals.

Figure 1:
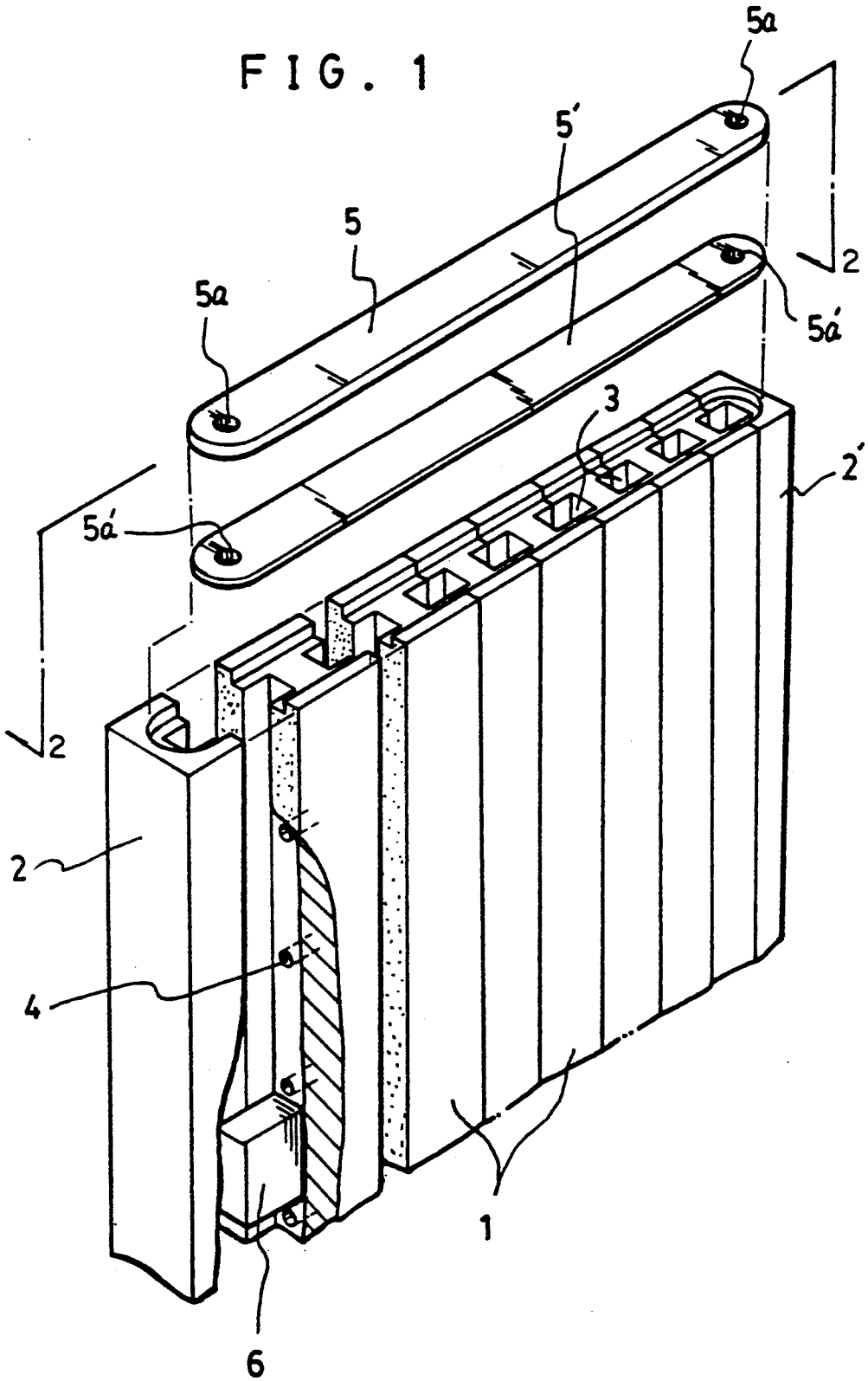
FIG. 1 is a perspective view of a part of the laminated lumber door according to the present invention.
Figure 2:
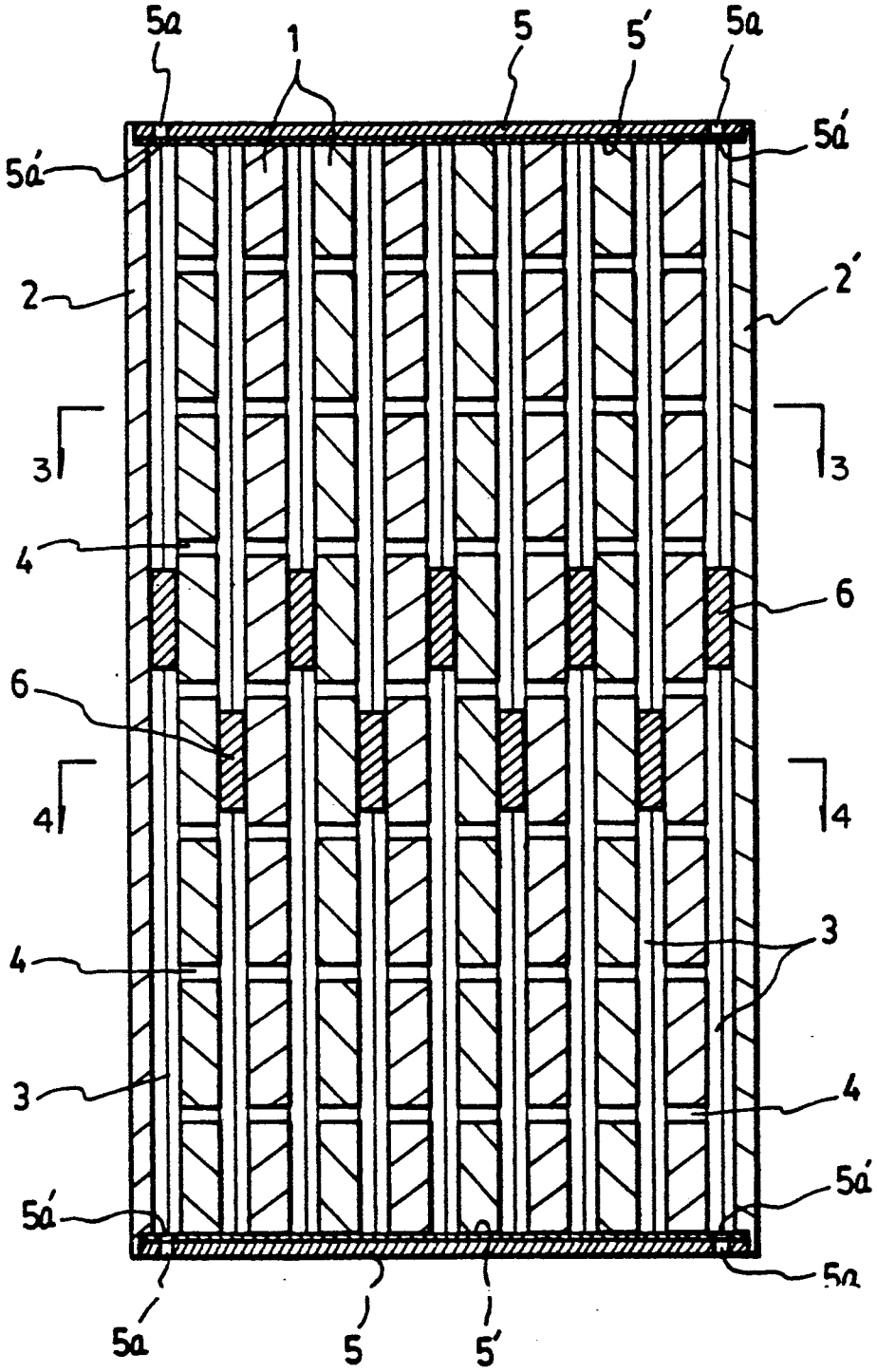
FIG. 2 is a sectional view taken along the line 2—2 of the assembled structure of FIG. 1.
Figure 3:
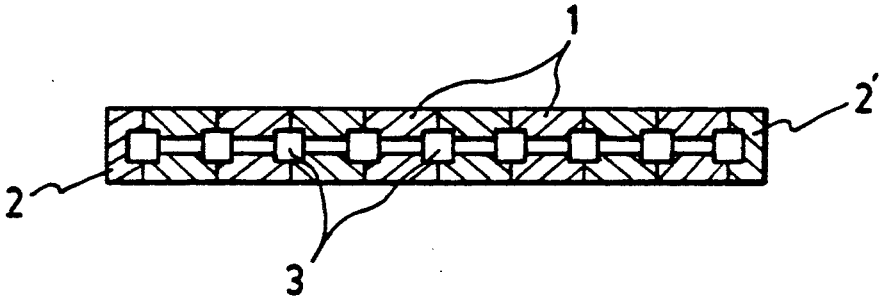
FIG. 3 is a sectional view taken along the line 3—3 FIG. 2 (a lateral sectional view of the assembled structure of FIG. 1)
Figure 4:
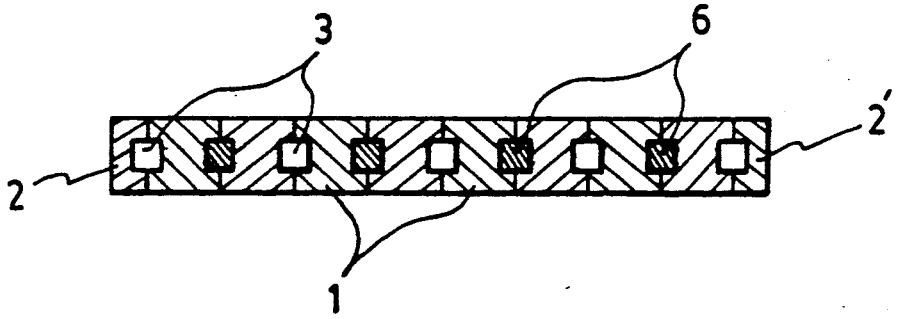
FIG. 4 is a sectional view taken along the line 4—4 FIG. 2 (a lateral sectinal view of the assembled structure of FIG. 1)
Figure 5:
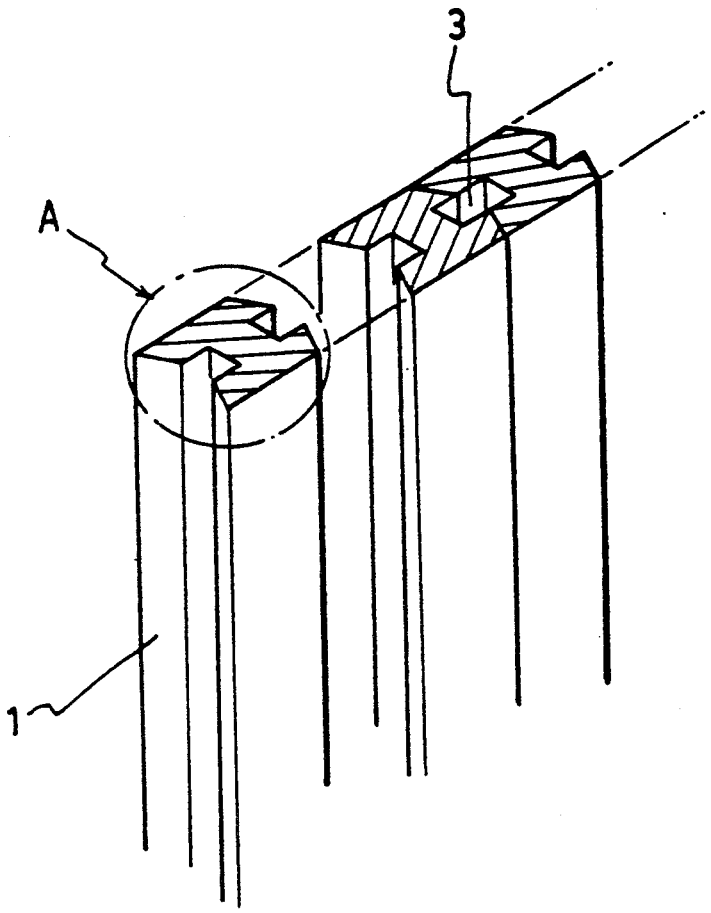
FIG. 5 is an illustration of another embodiment of the laminated lumber used in the door according to the present invention.
Figure 6:
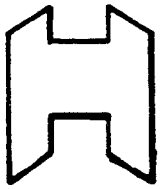
FIG. 6 is a plan view of the portion A of FIG. 5.
Figure 7:
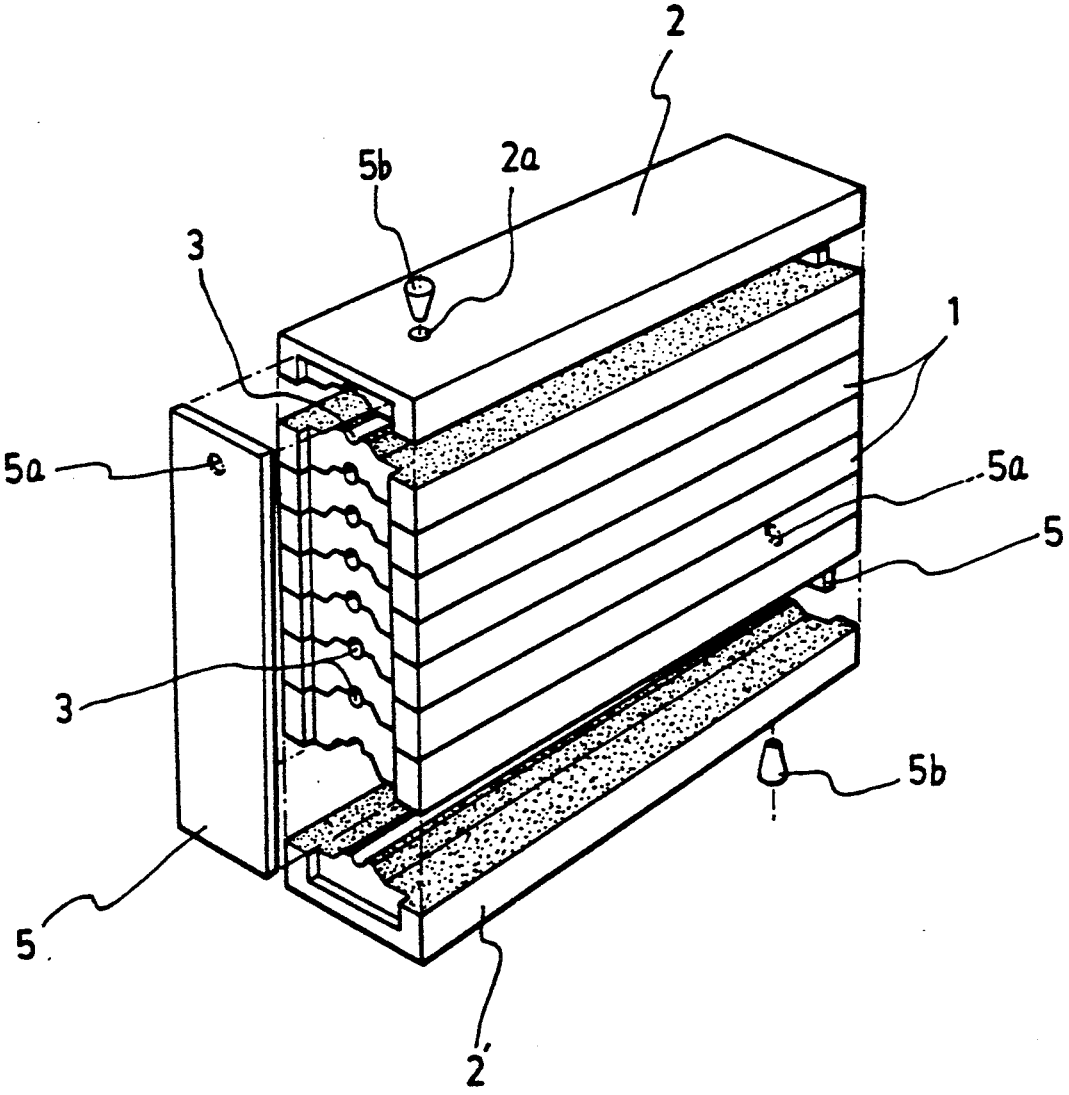
FIG. 7 is an exploded perspective view of another embodiment of the laminated lumber door according to the present invention.

As the final assembling step, a pair of fastening plates 5 having small holes **5*a* are mounted to the top and bottom of the assembly of the inner laminas 1 and the outer laminas 2,2', and, if desired, a pair of metal supporting plates 5' having small holes 5*a'* may be inserted between the assembly of the inner laminas 1 and the outer laminas 2,2' and the pair of fastening plates 5. Further, as shown in FIG. 2, reinforcing members 6 are buried within the longitudinal ventilating holes 3 in an alternately separated form in order to reinforce the strength of the door. Further, as shown in the embodiment of FIG. 5, the cross sectional shape of the inner laminas 1** can take the form of " " like wedges, for ease of assembly.

Further, the small holes **5*a* which are provided on the fastening plates 5 in order for them to communicate with the longitudinal and lateral ventilating holes 3, 4** can be provided either in a single number or in a plural number.

Figure 8:
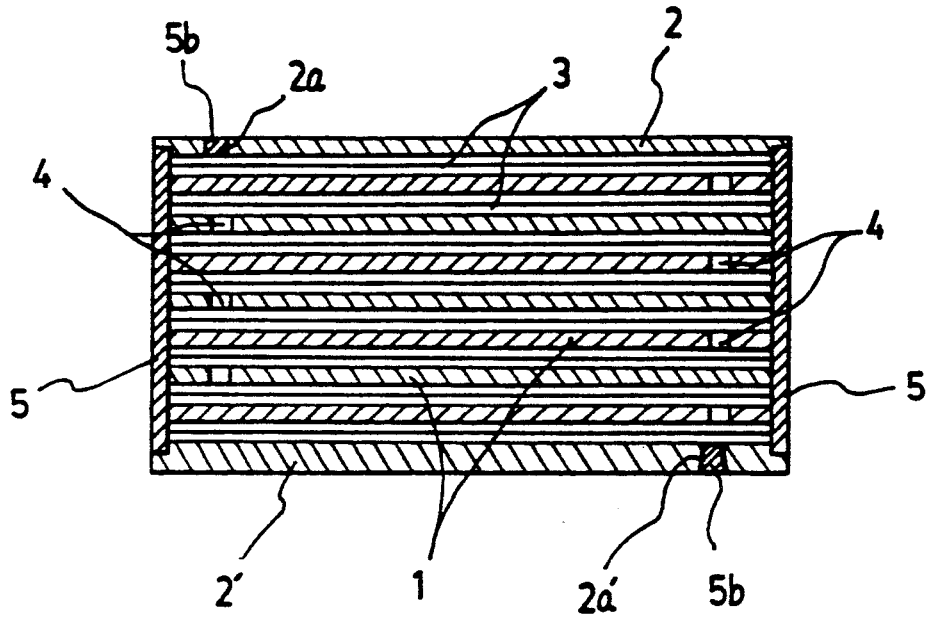
FIG. 8 is a longitudinal sectional view of the assembled structure of FIG. 7.
Figure 10:
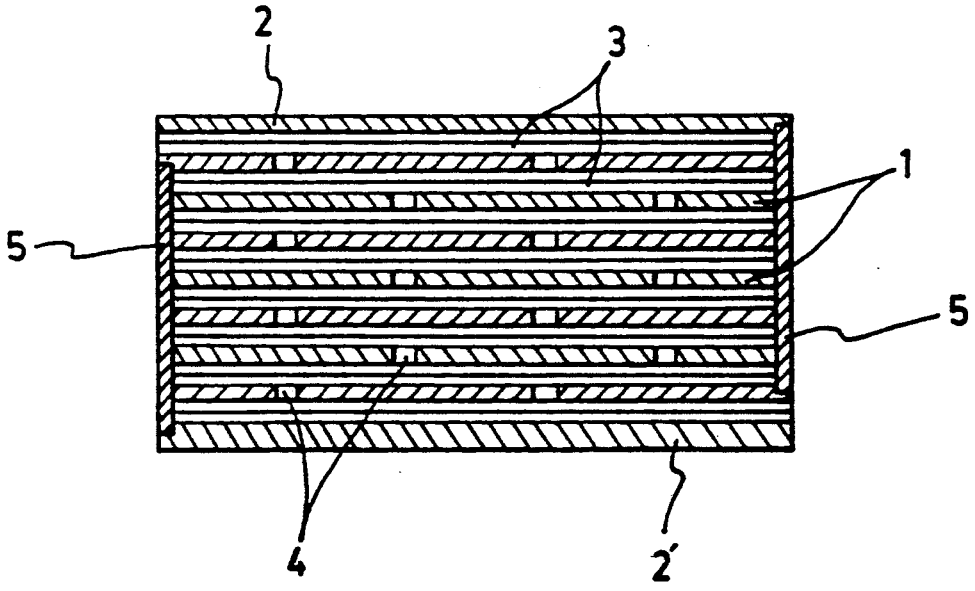
FIG. 10 is a longitudinal sectional view of the assembled structure of FIG. 9.
Figure 9:
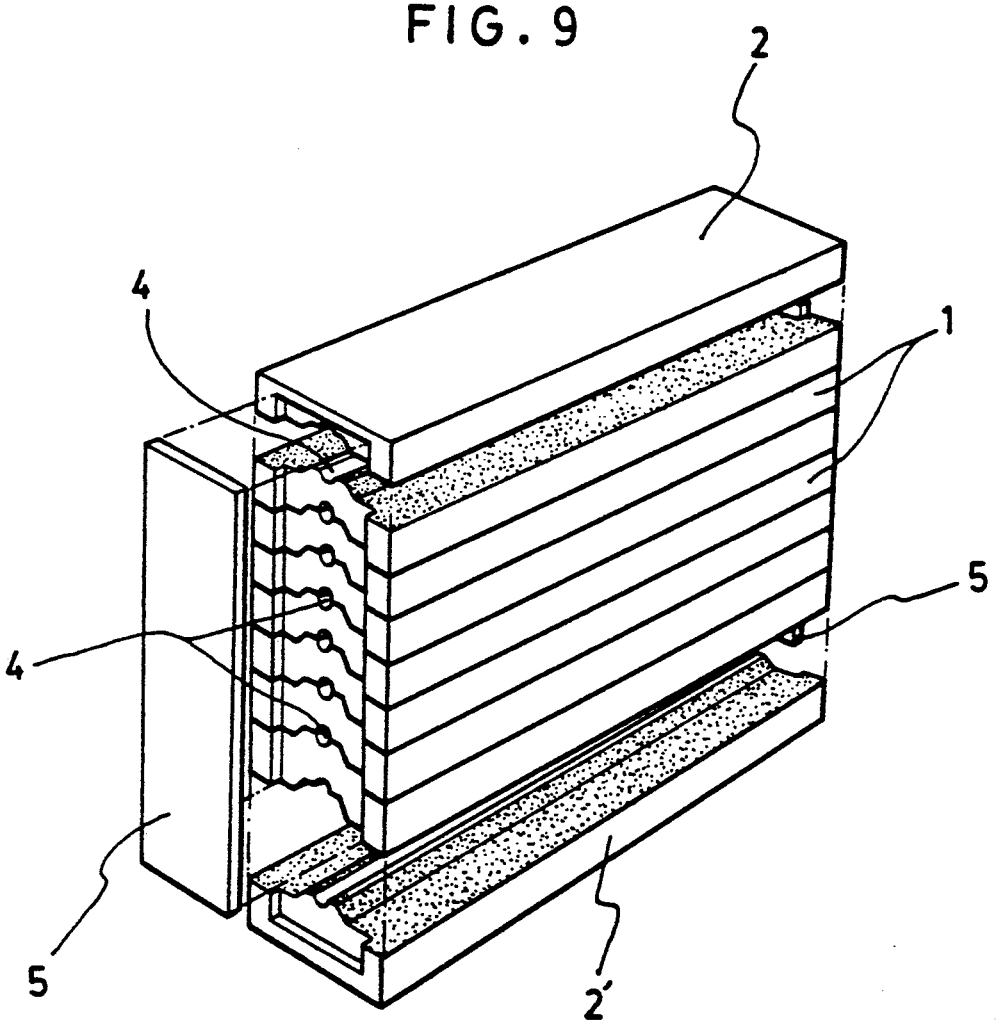
FIG. 9 is an exploded perspective view of still another embodiment of the laminated lumber door according to the present invention.
Figure 11:
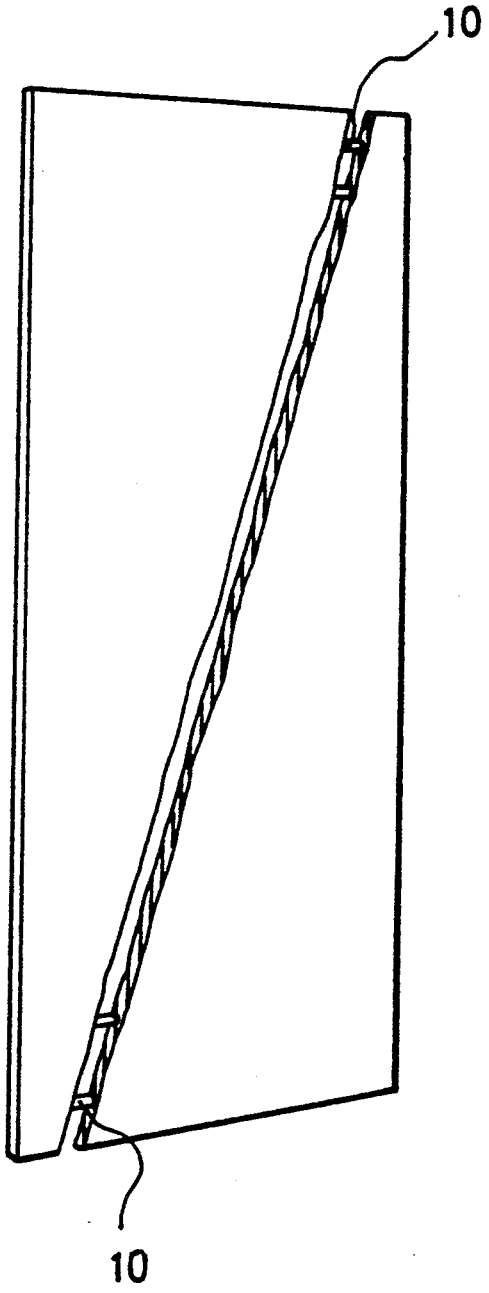
FIG. 11 PRIOR ART
FIG. 11 is a perspective view of the conventional laminated lumber door, with the door cut along the diagonal line.

Meanwhile, as to the cross sectional shape of the laminas 1, it can take the shape of " " as shown in the embodiment of FIG. 9 so as for the assembled laminas 1 to have a circular cross sectional ventilating holes 3. In addition, small holes **2*a*, 2*a'* (FIG. 8) can be provided on the outer laminas 2, 2', in such a manner that the small holes 2*a*, 2*a'* should be open to the ventilating holes 3, 4, and a closing member 5*b* can be put into each of the small holes 2*a*, 2*a'***.

The forming process for the laminated lumber door according to the present invention will be described in further detail below. First, a plurality of lateral ventilating holes 4 are formed through each of the molded laminas 1 at certain intervals.

Then the reinforcing members 6 are placed in the longitudinal channels of the laminas 1 in an alternately separated manner, and the inner laminas 1 are assembled in a planar form. Then the outer laminas 2, 2' are positioned against the opposite sides of the assembly of the inner laminas 1, and then, a high power press is used to compress the assembly of the inner laminas 1 and the outer laminas 2, 2'.

After completing the assembly, warm air can be circulated through the longitudinal and lateral ventilating holes 3, 4, so that the adhesive used thereon and the whole assembly can be quickly dried. This drying process not only shortens drying time, but also improves the strength and the heat insulating property of the laminated lumber door.

Then the top and the bottom of the assembly of the inner laminas 1 and the outer laminas 2, 2' are cut out, and the fastening plates 5 having the small holes **5*a* are put to the cut-out portions of the assembly. At this time, the metal supporting plates 5' having the small holes 5*a'*, if desired, may be inserted between the fastening plates 5** and the cut-out portions.

Then if a nice pattern is inscribed on the door, the laminated lumber door according to the present invention is finished.

According to the laminated lumber door of the present invention, air can be always circulated through the small holes **5*a* of the fastening plates 5 and through the longitudinal and lateral ventilating holes 3, 4 which are formed within the assembly of the inner laminas 1 and the outer laminas 2,2'**. Therefore, twisting of the door and other deformation can be prevented, and a light weight door can be realized.

Further, the pleasant natural wood odor is spread out from the inside of the door all the time, thereby making the people living inside pleasant. Further owing to the provision of the reinforcing members 6, deformations and damages to the door can be prevented even under a strong impact.

Further, in the case where the laminated lumber door of the present invention is used as a living room door, a heat insulating effect and a sound shielding effect can be obtained. Further, in the case where the laminated lumber door of the present invention is used as a furniture door, a moisture blocking effect and a deformation preventing effect can be obtained, thereby improving the prestige of the furniture. Further, various patterns can be inscribed on the door, and therefore, the apparent quality and the prestige of the furniture can be also improved, as well as improving the effectiveness of the furniture. The laminated lumber door according to the present invention can be justly named a respirating door.

What is claimed is:

1. A laminated lumber door, comprising a door assembly including a plurality of inner laminas and a pair of outer laminas, the outer laminas being mounted to opposite sides of the assembled inner laminas, the door assembly further including longitudinal ventilating holes formed between and along adjacent ones of the laminas and lateral ventilating holes connecting and crossing the longitudinal ventilating holes; and a pair of fastening plates having small holes, the fastening plates being mounted to the top and bottom of the assembly, and the small holes communicating with the longitudinal and lateral ventilating holes.

2. The laminated lumber door as claimed in claim 1, wherein the cross section of each of the inner laminas takes the form of " 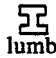 ".

3. The laminated lumber door as claimed in claim 1, wherein the cross section of each of the inner laminas takes the form of " 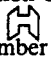 " like wedges.

4. The laminated lumber door as claimed in claim 1, further comprising reinforcing members being disposed between the laminas and toward the middle portions of the laminas in an alternately separated manner.

5. The laminated lumber door as claimed in claim 1, wherein plural small holes are provided in the fastening plates.

6. The laminated lumber door as claimed in claim 1, wherein the cross section of each of the inner laminas takes the form of " 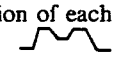 ".

7. The laminated lumber door as claimed in claim 1, further comprising a pair of metal supporting plates having small holes, the supporting plates being inserted between the assembly of the inner laminas and the outer laminas and the fastening plates, and the small holes communicating with the small holes formed on the fastening plates.

* * * * *